US007473318B2

(12) United States Patent
Jung et al.

(10) Patent No.: US 7,473,318 B2
(45) Date of Patent: Jan. 6, 2009

(54) CLEANING UNIT, SLIT COATING APPARATUS HAVING THE SAME AND METHOD OF COATING SUBSTRATE

(75) Inventors: Sung-Ki Jung, Suwon-si (KR); Ho-Min Kang, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 375 days.

(21) Appl. No.: 10/789,330

(22) Filed: Feb. 26, 2004

(65) Prior Publication Data

US 2004/0213913 A1 Oct. 28, 2004

(30) Foreign Application Priority Data

Apr. 23, 2003 (KR) ..... 10-2003-0025695

(51) Int. Cl.
*B05B 15/02* (2006.01)

(52) U.S. Cl. ..... 118/302; 118/300; 118/410; 238/106; 238/114; 238/568

(58) Field of Classification Search ..... 118/52, 118/612, 319, 312, 300, 302, 326, 410, 70, 118/203; 239/568, 104–123; 134/198, 153; 396/611, 612; 427/420, 427.1
See application file for complete search history.

(56) References Cited

U.S. PATENT DOCUMENTS

| | | | | |
|---|---|---|---|---|
| 3,933,186 | A * | 1/1976 | Scheffler | 141/97 |
| 5,273,192 | A * | 12/1993 | Kamiya | 222/152 |
| 5,374,312 | A * | 12/1994 | Hasebe et al. | 118/52 |
| 5,772,764 | A * | 6/1998 | Akimoto | 118/319 |
| 6,019,843 | A * | 2/2000 | Park et al. | 118/52 |
| 6,210,481 | B1 * | 4/2001 | Sakai et al. | 118/697 |
| 2001/0003966 | A1 * | 6/2001 | Kitano et al. | 118/70 |

* cited by examiner

*Primary Examiner*—Yewebdar T Tadesse
(74) *Attorney, Agent, or Firm*—MacPherson Kwok Chen & Heid LLP

(57) ABSTRACT

A cleaning unit of this invention includes a body and a cleaning member. The body includes an upper face. The upper face subsides to form a receiving recession for receiving a slit nozzle of the slit coater. The receiving recession includes a sidewall and a bottom face. The sidewall includes a first injection hole. A cleaning material is sprayed via the injection hole. The cleaning member eliminates dregs of the material attached on the slit nozzle of the slit coater. The cleaning member is attached on the bottom face of the receiving recession. According to the present invention, the slit nozzle is effectively cleared, so that the substrate is uniformly coated with the photosensitive layer, and the photosensitive layer is not scratched.

15 Claims, 4 Drawing Sheets

CLEANING UNIT, SLIT COATING APPARATUS HAVING THE SAME AND METHOD OF COATING SUBSTRATE

CROSS-REFERENCE TO RELATED APPLICATIONS

This application relies for priority upon Korean Patent Application No. 2003-25695 filed on Apr. 23, 2003, the contents of which are herein incorporated by reference in its entirety.

BACKGROUND OF THE INVENTION

1. Field of the Invention

The present invention relates to a cleaning unit, a slit coating apparatus having the cleaning unit, and a method of coating a substrate, more particularly to a cleaning unit enhancing efficiency of coating process, a slit coating apparatus having the cleaning unit, and a method of coating a substrate.

2. Description of the Related Art

In general, a photosensitive material is used for patterning a thin film that performs a special function. The photosensitive material chemically reacts on light. When the photosensitive material is not coated uniformly, deterioration occurs in next processes.

When the photosensitive material is coated thicker than a predetermined thickness on a thin film, the thin film is under-etched. When the photosensitive material is coated thinner than the predetermined thickness, the thin film is over-etched.

A spin coating method is widely used as a method of uniformly coating the substrate with the photosensitive material. According to the spin coating method, the photosensitive material is dropped on a substrate, while the substrate is rotated rapidly. Therefore, the photosensitive material is spread on the substrate. However, the spin coating method is not preferable in order that the substrate of a liquid crystal display panel is coated with the photosensitive material, because the substrate of the liquid crystal display device is heavy and large. When the substrate of the liquid crystal display device is heavy and large, rotating the substrate is hard, and the substrate is damaged (or broken) easily.

Therefore, a slit coating method is introduced recently so as to coat the substrate of the liquid crystal display device with the photosensitive material. According to the slit coating method, the photosensitive material is provided to the substrate via a slit.

A slit coater for coating the substrate includes the slit. A length of the slit is substantially equal to a width of the substrate that is coated with the photosensitive layer. A width of the slit is substantially equal to a thickness of the photosensitive layer with which the substrate is coated. The slit coater discharges the photosensitive material via the slit having definite width. Therefore, the slit coater coats the substrate with the photosensitive material, while moving in a longitudinal direction of the substrate. Therefore, the substrate is coated with the photosensitive material by uniform thickness.

However, when the slit coater repeats coating operation, dregs are attached on the slit nozzle of the spin coater, so that a uniformity of a photosensitive layer formed on the substrate is deteriorated. As a result, a display quality of the liquid crystal display device is deteriorated.

SUMMARY OF THE INVENTION

Accordingly, there is provided a cleaning unit for enhancing efficiency of cleaning.

It is a feature of the present invention to provide a slit coating apparatus having the cleaning unit.

In one aspect of the present invention, there is provided a method of coating a substrate.

According to the cleaning unit of this invention, the cleaning unit for cleaning a slit coater for coating materials on a substrate includes a body and a cleaning member. The body includes an upper face. The upper face subsides to form a receiving recession for receiving a slit nozzle of the slit coater. The receiving recession includes a sidewall and a bottom face. The sidewall includes a first injection hole. A cleaning material is sprayed via the injection hole. The cleaning member eliminates dregs of the material attached on the slit nozzle of the slit coater. The cleaning member is attached on the bottom face of the receiving recession.

According to the slit coating apparatus of the present invention, the slit coating apparatus includes a supporting member, a slit coater and a cleaning unit. The supporting member supports a substrate. The slit coater coats the substrate with predetermined material. The slit coater includes a slit nozzle having a slit for discharging the material. The cleaning unit cleans the slit coater. The cleaning unit includes a body and a cleaning member. The body includes an upper face. The upper face subsides to form a receiving recession for receiving a slit nozzle of the slit coater. The receiving recession includes a sidewall and a bottom face. The sidewall includes a first injection hole. A cleaning material is sprayed via the injection hole. The cleaning member eliminates dregs of the material attached on the slit nozzle of the slit coater. The cleaning member is attached on the bottom face of the receiving recession.

According to the method of coating a substrate, a cleaning material is sprayed to a slit nozzle of a slit coater so as to saturate dregs attached on the slit nozzle with the cleaning material. The slit nozzle is scrubbed according to a longitudinal direction of the slit nozzle so as to eliminate the dregs. Then, the substrate is coated with the slit coater.

According to the cleaning unit, the slit coating apparatus having the cleaning unit, and the method of coating a substrate of the present invention, the slit coater is cleaned before or after the slit coater forms the photosensitive layer on the substrate with the photosensitive material. The cleaning unit includes the first injection hole through which the cleaning material is sprayed, and the cleaning member for rubbing the substrate so as to eliminate the dregs.

Therefore, the slit nozzle is effectively cleared, so that the substrate is uniformly coated with the photosensitive layer, and the photosensitive layer is not scratched.

BRIEF DESCRIPTION OF THE DRAWINGS

The above and other features and advantages of the present invention will become more apparent by describing in detail the preferred embodiments thereof with reference to the accompanying drawings, in which.

DESCRIPTION OF PREFERRED EMBODIMENTS

Hereinafter, the preferred embodiments of the present invention will be described in detail with reference to the accompanying drawings.

Figure 1:
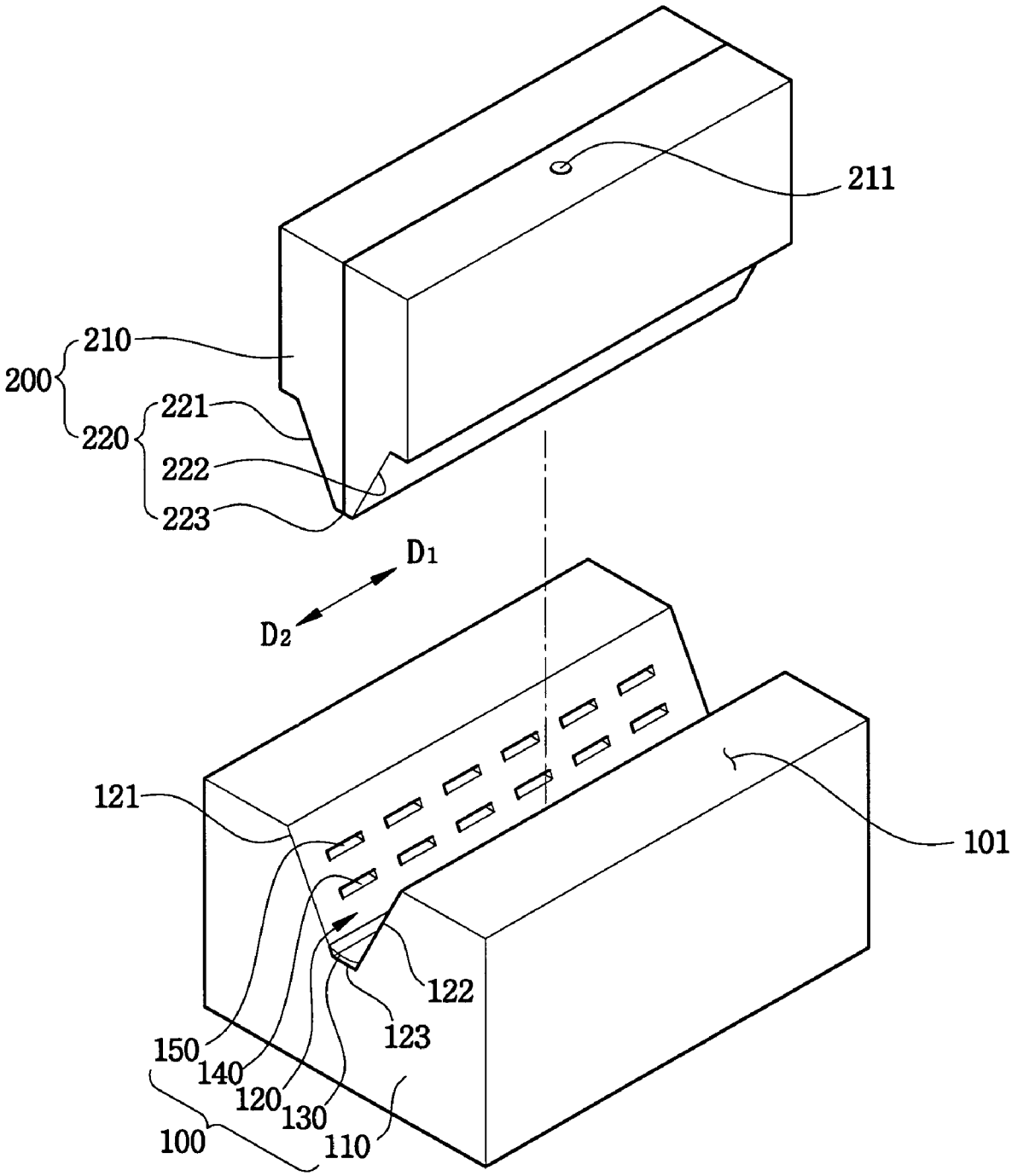
FIG. 1 is a perspective view showing a cleaning unit according to a first exemplary embodiment of the present invention.
Figure 2:
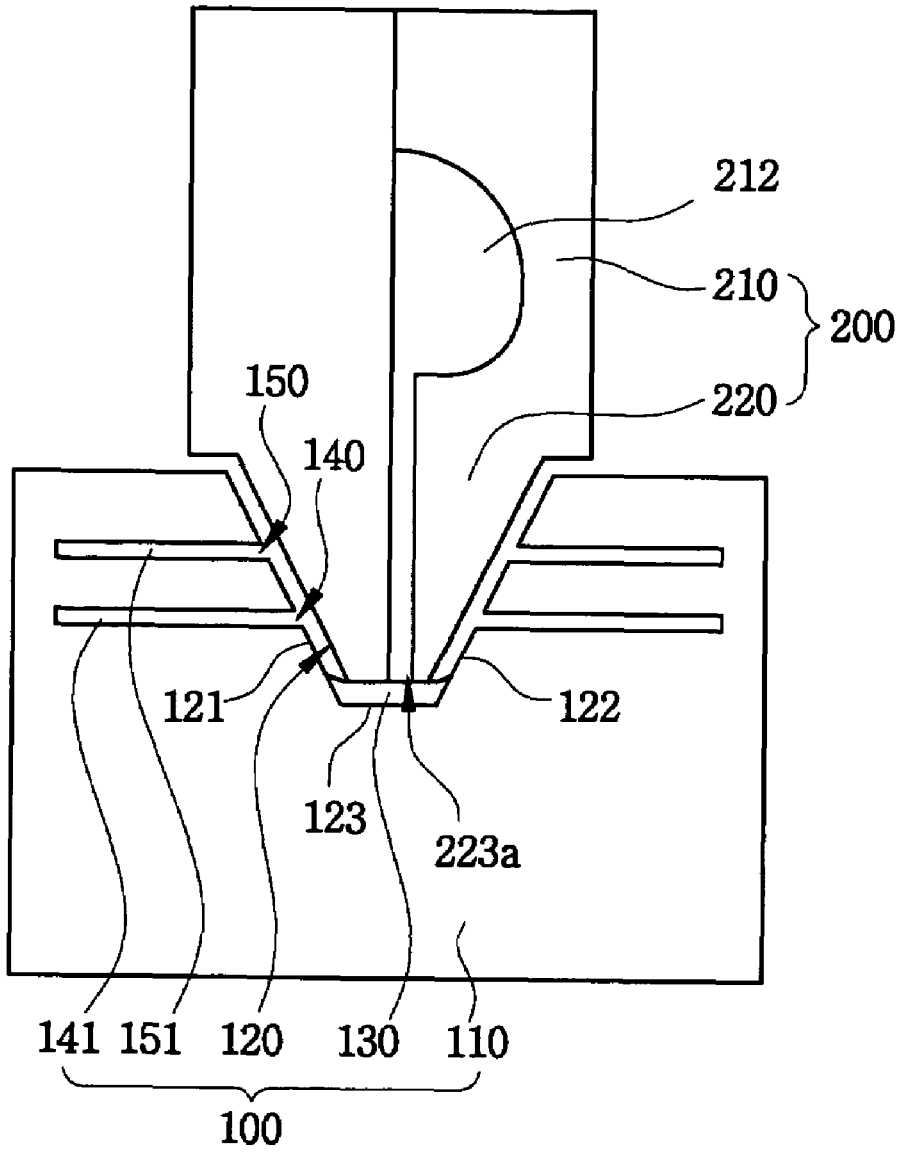
FIG. 2 is a cross-sectional view showing the cleaning unit of FIG. 1.

FIG. 1 is a perspective view showing a cleaning unit according to a first exemplary embodiment of the present invention, FIG. 2 is a cross-sectional view showing the cleaning unit of FIG. 1.

Referring to FIGS. 1 and 2, a cleaning unit 100 includes a cleaning unit body 110. The cleaning unit body 110 has an upper face 101. The cleaning body 110 of the cleaning unit 100 is hexahedron-shaped. The upper face 101 subsides to form a receiving recession 120.

The receiving recession 120 includes sidewalls and a bottom face 123. The sidewalls include a first inclined face 121 and a second inclined face 122. The first inclined face 121 and the second inclined face 122 forms an angle that is larger than 90° with respect to the upper face 101 respectively. The bottom face 123 of the receiving recession 120 is parallel with the upper face 101 of the cleaning unit body 110.

The first inclined face 121 includes a plurality of first injection holes 140 and a plurality of second injection holes 150. The second inclined face 122 includes a plurality of the first injection holes 140 and a plurality of the second injection holes 150.

A cleaning material is sprayed via the first injection hole 140, and gas such as air and nitrogen gas is sprayed via the second injection hole 150.

The body includes a first pipe 141 and a second pipe 151. The first pipe 141 is connected with the first injection hole 140. The cleaning material is transferred to the first injection hole 140 through the first pipe 141 to be sprayed through the first injection hole 140. The second pipe 151 is connected with the second injection hole 150. The gas is transferred to the second injection hole 150 through the second pipe 151 to be sprayed through the second injection hole 150.

The first pipe 141 may be plural or singular. When the first pipe 141 is singular, the first pipe 141 is connected with all of the first injection holes 140. When the first pipe 141 is plural, the first pipes 141 are connected with the first injection holes 140 respectively. When the first pipe 141 is plural, a speed of current of the cleaning material is enhanced.

The second pipe 151 may be plural or singular. When the second pipe 151 is singular, the second pipe 151 is connected with all of the second injection holes 150. When the second pipe 151 is plural, the second pipes 151 are connected with the second injection holes 150 respectively.

In FIGS. 1 and 2, both of the first inclined face 121 and on the second inclined face 122 have the first injection holes 140 through which the cleaning material is sprayed and the second injection holes 150 through which the gas is sprayed separately.

However, both of the cleaning material and the gas may be sprayed via the first injection holes 140. Namely, the cleaning material is sprayed via the first injection holes 140 so as to eliminate the dregs attached on a slit nozzle 220 of a slit coater 200. Then, the gas for drying the slit nozzle 220 is sprayed via the first injection holes 140.

A cleaning member 130 is detachably attached on the bottom face 123 of the receiving recession 120. The cleaning member 130 may includes material that has elasticity such as rubber or Teflon.

The slit coater 200 coats a substrate (not shown) with photosensitive material. The slit coater 200 includes a coater body 210 and a slit nozzle 220 elongated from the coater body 210. The coater body 210 includes a hole 211. The photosensitive material is injected into the coater body 210 via the hole 211 to be stored in a storage hollow 212 formed in the cleaning unit body 110.

The slit nozzle 220 includes a third inclined face 221, a fourth inclined face 222 and a connection face 223. The third inclined face 221 is substantially parallel with the first inclined face 121 of the receiving recession 120. The fourth inclined face 222 is substantially parallel with the second inclined face 122 of the receiving recession 120. The connection face 223 connects the third inclined face 221 and the fourth inclined face 222. The connection face 223 includes a slit 223*a*.

The cleaning unit 100 cleans the slit nozzle 220, after (or before) the slit nozzle 220 coats the substrate (not shown) with the photosensitive material.

The receiving recession 120 receives the slit nozzle 220. A contour of the receiving recession 120 corresponds to a contour of the slit nozzle 220. When the receiving recession 120 receives the slit nozzle 220, the connection face 223 of the slit nozzle 220 makes contact with the cleaning member 130 attached on the bottom face 123 of the receiving recession 120.

Then the cleaning material is sprayed toward the third inclined face 221 and the fourth inclined face of the slit nozzle 220 via the first injection hole 140, so that the dregs of the photosensitive material, which are attached on the third inclined face 221 and the fourth inclined face of the slit nozzle 220, are eliminated. Further the cleaning material saturates the dregs attached on the slit 223*a*.

Then the cleaning unit body 110 of the cleaning unit 100 moves in a first direction $D_1$, so that the dregs attached on the slit 223*a* are eliminated. The dregs attached on the slit 223*a* are saturated enough. Therefore, the dregs attached on the slit 223*a* are easily eliminated.

The cleaning member 130 includes elastic material to protect the connection face 223 of the slit nozzle 220.

The cleaning member 130 may be abraded by repeated cleaning operation. The cleaning member 130 is detachably attached on the bottom face 123 of the receiving recession 120. Therefore, the cleaning member may be replaced easily and promptly, when the cleaning member 130 is abraded. When the cleaning member 130 is detachably attached on the bottom face 123, an efficiency of replacing operation is enhanced.

When the cleaning unit body 110 of the cleaning unit 100 arrives at a distal end of the slit nozzle 220 in the first direction $D_1$, the cleaning unit body 110 of the cleaning unit 100 moves in a second direction $D_2$ opposite to the first direction $D_1$.

The gas is sprayed via the second injection hole 150 so as to dry the slit nozzle 220 of the slit coater 220, while the cleaning unit body 110 of the cleaning unit 100 moves in the second direction $D_2$. Further, the dregs may be detached from the slit nozzle 220 by the sprayed gas. The cleaning unit body 110 of the cleaning unit 100 may move in the second direction $D_2$, on condition that the connection face 223 makes contact with the cleaning member 130.

Hereinbefore, the cleaning unit body 110 of the cleaning unit 100 moves in the first direction $D_1$ or in the second direction $D_2$, while the slit coater 200 is fixed. However, the slit coater 200 may move in the first direction $D_1$ or in the second direction $D_2$, while the cleaning unit body 110 of the cleaning unit 100 is fixed.

When the dregs are attached on the slit 223*a* of the slit nozzle 220, the dregs may scratch the photosensitive layer with which the substrate is coated, and the substrate layer may be coated non-uniformly with the photosensitive.

Therefore, when the slit nozzle 220 is cleared, defects formed during the process of coating are reduced.

Figure 3:
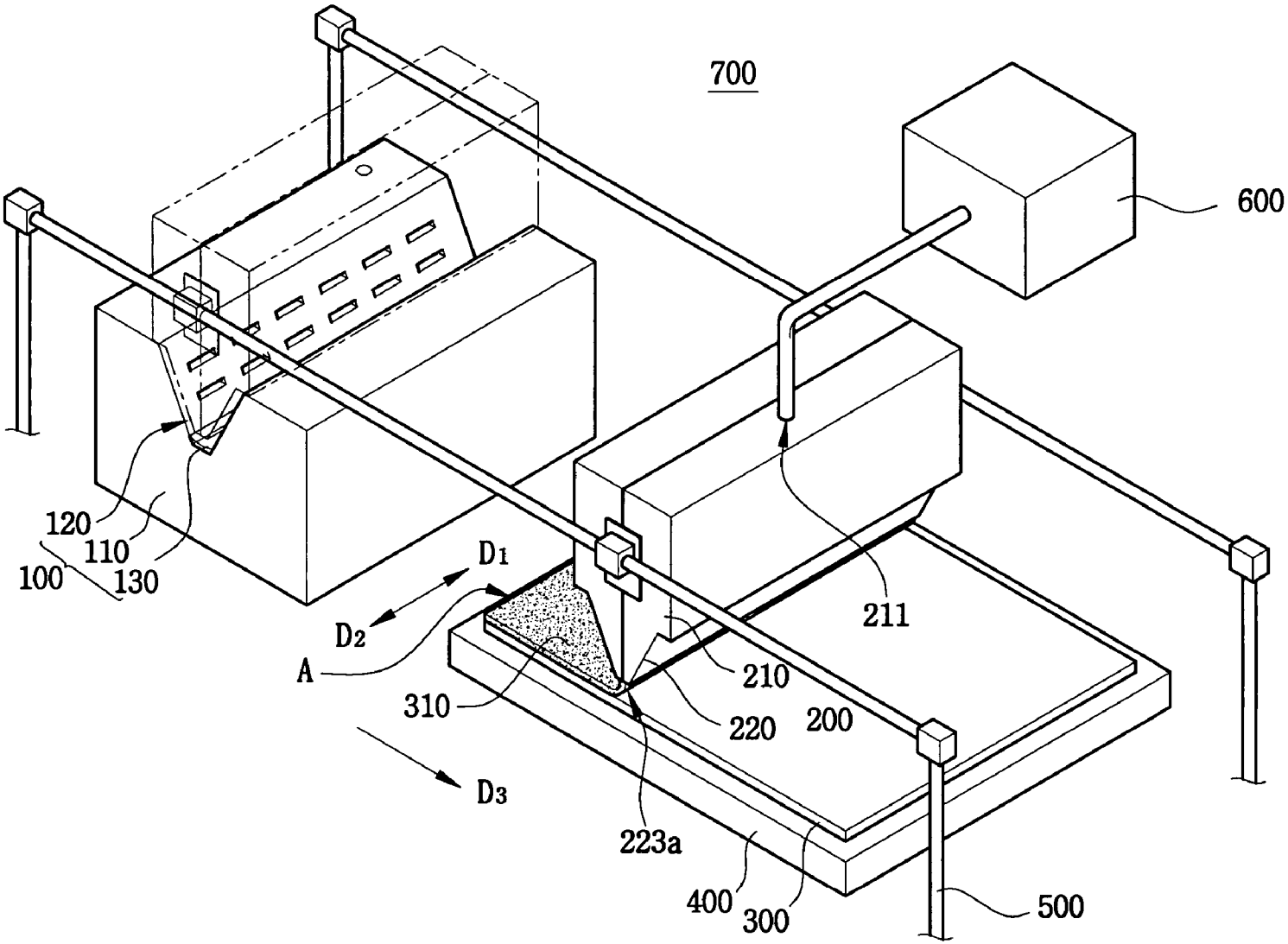
FIG. 3 is a perspective view showing a slit coating apparatus according to a second embodiment of the present invention.

FIG. 3 is a perspective view showing a slit coating apparatus according to a second embodiment of the present invention. In FIG. 3, the same reference numbers will be used to refer to the same or like parts as those shown in FIG. 1.

Referring to FIGS. 1, 2 and 3, a slit coating apparatus 700 according to a second embodiment of the present invention includes a supporting member 400. The supporting member 400 supports a substrate 300 so as to coat the substrate 300 with a photosensitive layer 310. The supporting member 300 makes contact with a second face of the substrate 300. The second face of the substrate 300 faces a first face of the substrate 300. The first face of the substrate 300 is coated with the photosensitive layer 310.

The slit coating apparatus 700 also includes a slit coater 200 for coating the photosensitive layer 310 on the first face of the substrate 300. The silt coater 200 includes a coater body 210 and a slit nozzle 220.

A photosensitive material supplying unit 600 supplies the slit coater 211 with the photosensitive material via a hole 211. A storage hollow 212 is formed in the coater body 210.

The slit nozzle 220 is elongated from the coater body 210. The slit nozzle 220 includes the slit 223*a*.

The slit nozzle 220 includes the third inclined face 221, the fourth inclined face 222 and the connection face 223. The connection face 223 connects the third inclined face 221 and the fourth inclined face 222. The third inclined face 221 is inclined toward the fourth inclined face 222. The fourth inclined face 222 inclined toward the third inclined face 221.

The slit coater 200 is connected with a transferring unit 500. The transferring unit 500 transfers the slit coater 200 disposed over the substrate 300 in a third direction $D_3$. The slit coater 200 coats the substrate 300 with the photosensitive material while the transferring unit 500 transfers the slit coater 200 in the third direction $D_3$. The photosensitive material is discharged through the slit 223 having predetermined width corresponding to the thickness of the photosensitive layer 310. Therefore the photosensitive layer 310 is uniformly coated on the substrate 310.

When the slit coater 200 coats the substrate 310 with the photosensitive material repeatedly, a residue of the photosensitive material is attached on the slit nozzle 220 and cured to form dregs.

The cleaning unit 100 scrubs the slit nozzle 220 to eliminate the dregs, while the slit coater 200 is fixed and the cleaning unit 100 moves in the first direction $D_1$ and in the second direction $D_2$. Therefore, the photosensitive layer 310 having uniform thickness is formed on the substrate 300.

Figure 4:
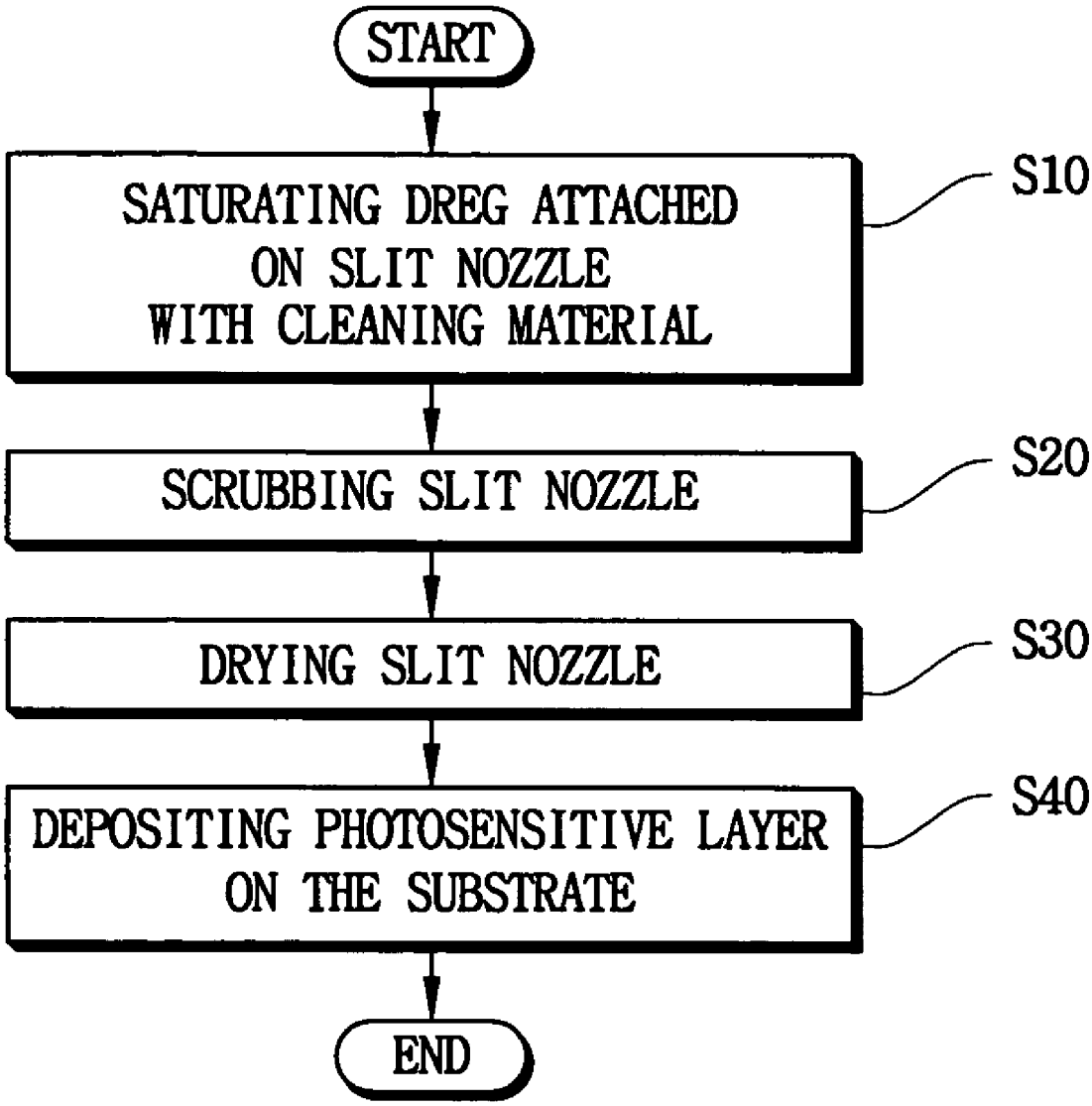
FIG. 4 is a flow chart showing a method of coating according to a third embodiment of the present invention.

FIG. 4 is a flow chart showing a method of coating according to a third embodiment of the present invention.

Referring to FIGS. 3 and 4, the receiving recession 120 of the cleaning unit 100 receives the slit nozzle 220. The cleaning material is sprayed via the first injection hole 140 of the receiving recession 120 toward the slit nozzle 220, while the cleaning unit 100 moves in the first direction $D_1$. Then the dregs of the photosensitive material are saturated with the cleaning material (step S10).

The connection face 223 of the slit nozzle 220 makes contact with the cleaning member 130. Therefore, when the cleaning unit 100 moves in the first direction D1, the cleaning member 130 scrubs the connection face 223 to eliminate the dregs (step S20).

The gas is sprayed via the second injection hole 150 toward the slit nozzle 220, while the cleaning unit 100 moves in the second direction $D_2$ so as to dry the slit nozzle 220 (step S30). When the slit nozzle 220 is dried, the process of cleaning the slit nozzle 220 is finished.

Then the substrate 300 is prepared on the supporting member 400 of the slit coating apparatus 700. The slit coater 200 moves from the cleaning unit 100 toward the supporting member 400, so that the slit coater 200 is disposed over an edge portion "A" of the substrate 300. The slit coater 200 discharges the photosensitive material through the slit 223*a*, while the slit coater 200 moves in the third direction $D_3$. Therefore, the photosensitive layer 310 having uniform thickness is formed on the substrate 300 (step S40).

According to the cleaning unit, the slit coating apparatus having the cleaning unit, and the method of coating a substrate of the present invention, the slit coater is cleaned before or after the slit coater coats the substrate with the photosensitive material. The cleaning unit includes the first injection hole through which the cleaning material is sprayed, and the cleaning member for rubbing the connection face of the slit nozzle so as to eliminate the dregs.

Therefore, the slit nozzle is effectively cleared, so that the photosensitive layer having uniform thickness is formed on the substrate, and the photosensitive layer is not scratched.

While the exemplary embodiments of the present invention and its advantages have been described in detail, it should be understood that various changes, substitutions and alterations can be made herein without departing from the spirit and scope of the invention as defined by appended claims.

What is claimed is:

1. A cleaning unit for cleaning a slit coater for coating a substrate with a material, said cleaning unit comprising:

a body including an upper face, the upper face having a receiving recession for receiving a slit nozzle of the slit coater, the receiving recession having a sidewall and a bottom face, the sidewall having a first injection hole, a cleaning material being sprayed via the first injection hole; and a cleaning member for eliminating dregs of the material attached on the slit nozzle of the slit coater, the cleaning member covering the bottom face of the receiving recession, wherein the slit nozzle of the slit coater includes a first inclined face, a second inclined face and a connection face connecting the first inclined face with the second inclined face, and the cleaning member makes contact with the connection face of the slit nozzle of the slit coater during a cleaning process.

2. The cleaning unit of claim 1, wherein the cleaning member comprises an elastic material.

3. The cleaning unit of claim 2, wherein the elastic material is rubber or polytetrafluoroethylene.

4. The cleaning unit of claim 1, wherein the cleaning member is detachably attached on the bottom face.

5. The cleaning unit of claim 1, wherein the sidewall has a second injection hole, gas being sprayed via the second injection hole so as to dry the slit nozzle of the slit coater.

6. The cleaning unit of claim 1, wherein gas is sprayed via the first injection hole so as to dry the slit nozzle of the slit coater, after spraying the cleaning material.

7. The cleaning unit of claim 1, wherein the connection face having a slit for discharging the photosensitive material, the sidewall of the receiving recession includes a third inclined face and a fourth inclined face, the first inclined face being substantially parallel with the third inclined face and the second inclined face being substantially parallel with the fourth inclined face.

8. A cleaning unit for cleaning a slit coater for coating a substrate with a material, said cleaning unit comprising:

a body including an upper face, the upper face having a receiving recession for receiving a slit nozzle of the slit coater, the receiving recession having a sidewall and a bottom face, the sidewall having a first injection hole, a cleaning material being sprayed via the first injection hole, wherein the slit nozzle of the spin coater includes a first inclined face, a second inclined face and a connection face connecting the first inclined face with the second inclined face, the connection face having a slit for discharging the photosensitive material, the sidewall of the receiving recession includes a third inclined face and a fourth inclined face, the first inclined face being substantially parallel with the third inclined face and the second inclined face being substantially parallel with the fourth inclined face; and a cleaning member for eliminating dregs of the material attached on the slit nozzle of the slit coater, the cleaning member being attached on the bottom face of the receiving recession, wherein the cleaning member of the cleaning unit makes contact with the connection face of the slit nozzle of the slit coater during a cleaning process.

9. The cleaning unit of claim 1, wherein the material corresponds to a photosensitive material.

10. A cleaning unit for cleaning a slit coater for coating a substrate with a material, said cleaning unit comprising:

a body including an upper face, the upper face having a receiving recession for receiving a slit nozzle of the slit coater, the receiving recession having a sidewall and a bottom face, the sidewall having a first injection hole, a cleaning material being sprayed via the first injection hole; and a cleaning member for eliminating dregs of the material attached on the slit nozzle of the slit coater, the cleaning member directly covering the bottom face of the receiving recession, wherein the cleaning member makes contact with an end portion of the slit nozzle of the slit coater during a cleaning process.

11. The cleaning unit of claim 10, wherein the cleaning member comprises an elastic material.

12. The cleaning unit of claim 10, wherein the cleaning member is detachably attached on the bottom face.

13. The cleaning unit of claim 10, wherein the sidewall has a second injection hole, gas being sprayed via the second injection hole so as to dry the slit nozzle of the slit coater.

14. The cleaning unit of claim 10, wherein gas is sprayed via the first injection hole so as to dry the slit nozzle of the slit coater after spraying the cleaning material.

15. The cleaning unit of claim 10, wherein the body is hexahedron-shaped.

* * * * *